United States Patent [19]

Kudinov et al.

[11] Patent Number: 4,561,639

[45] Date of Patent: Dec. 31, 1985

[54] COOLING PLATE FOR METALLURGICAL FURNACES

[75] Inventors: Gennady A. Kudinov; Grigory I. Kasyanov; Evgeny E. Lysenko; Alexei I. Tolochko; Vasily A. Yazev, all of Kharkov; Vladimir M. Antonov, Zhdanov, all of U.S.S.R.

[73] Assignee: Vnipicermetenergoochistka, Moscow, U.S.S.R.

[21] Appl. No.: 513,966

[22] PCT Filed: Nov. 16, 1981

[86] PCT No.: PCT/SU81/00073

§ 371 Date: Jun. 16, 1983

§ 102(e) Date: Jun. 16, 1983

[87] PCT Pub. No.: WO83/01788

PCT Pub. Date: May 26, 1983

[51] Int. Cl.[4] ..... C21B 7/10

[52] U.S. Cl. ..... 266/193

[58] Field of Search ..... 266/193, 194, 190, 191, 266/197

[56] References Cited

U.S. PATENT DOCUMENTS

| | | | |
|---|---|---|---|
| 4,071,230 | 1/1978 | Zherdev et al. | 266/193 |
| 4,121,809 | 10/1978 | Dhelft | 266/193 |
| 4,235,173 | 11/1980 | Sharp | 266/194 |

FOREIGN PATENT DOCUMENTS

| | | | |
|---|---|---|---|
| 0950772 | 8/1980 | U.S.S.R. | 266/193 |

*Primary Examiner*—L. Dewayne Rutledge
*Assistant Examiner*—S. Kastler

[57] ABSTRACT

A duct for a cooling medium is formed by a channel (2) closed by a rear and end cover plates (3, 4) embedded in a metal of a plate (1) so that the rear cover plate (3) is free from said metal. On the rear cover plate (3) are provided branch pipes (5) for feeding the cooling medium into the duct and discharging the same therefrom.

2 Claims, 6 Drawing Figures

COOLING PLATE FOR METALLURGICAL FURNACES

TECHNICAL FIELD

The present invention relates to cooling equipment used in metallurgical production, and particularly to cooling plates of metallurgical furnaces.

Cooling plates of such a type, comprising a metallic plate proper and a duct for a cooling medium, provided in said plate, are used in metallurgical shaft furnaces, e.g. in blast furnaces. These cooling plates are identical irrespective of whether they are flat or provided with projections cooled by ducts extending therewithin, said projections adapted to support refractory brickwork of the furnace. Since the cooling plates utilized in the same furnace, with or without supporting projections are similar in design, the cooling plate being the object of the invention will be further called "a cooling plate of the above type".

BACKGROUND ART

Cooling plates of the above type (see Andonyev S. M. et al., Okhlazhdenie domennykh pechei, Moscow, "Metallurgia", 1972, s.216–220) are manufactured by pouring cast iron around steel cooling pipes so as to embed them in said cast iron, which forms a body of the plate. Such plates are cast either flat or provided with supporting projections. Said pipes are also used for cooling the projection, for which end these pipes are bent so as to enter the projection body. Cooling of said projections may also be effected through separate cooling pipes.

The cooling plates of the above type have portions which are located between the cooling pipes and at the elbows thereof, in which portions there exist a non-uniform thermal field and a low rate of heat removal. The non-uniform thermal field produces thermal stresses within the plate and pipes. The thermal stresses are also caused by the fact that cast iron and steel have different coefficients of thermal expansion. Furthermore, in the zone of outlet portions of the pipes there exist residual stresses formed during the process of pouring cast iron around the steel pipes. In the process of manufacturing the cooling plates the steel pipes may be carburized and, consequently loose plasticity in spite of application of protective coatings, e.g. marshalite ones. The above disadvantages result in a shorter service life of the cooling plates.

In the operation of the prior art cooling plates, in the case of burning-through of the cooling pipes there arise problems of finding and disconnecting the burnt pipes, and in particular the pipes of the supporting projections, which pipes are damaged first of all.

The object of the invention is to provide a more stable cooling plate of the above type due to a more uniform and intensive cooling thereof.

The object set forth is attained in the provision of a cooling plate of the above type for metallurgical furnaces, wherein according to the invention a duct for a cooling medium is constructed as an upwardly extending channel closed with cover plates at the rear and end sides thereof, said channel being cast into the plate metal so that the rear cover plate is not embedded in metal, branch pipes for feeding a cooling medium into the duct and for discharging the same from said duct being provided on the rear cover plate.

The cooling plate of such a design ensures a more uniform and reliable cooling due to the elimination of non-cooled angular portions. Since the duct for the cooling medium, constructed in the form of a channel, can cover a large area of the plate, so that the problem of interpipe distances is completely solved. The provision of the branch pipes for feeding and discharging the cooling medium on the rear side of the cover plate which is not embedded in metal, eliminates the problem of residual stresses in the plate and the pipes, said stresses being caused by jamming of the discharge portions of the pipes and by different coefficients of elongation of cast iron and steel, if these materials are utilized. Besides, a large mass of the channels as compared with that of the cooling pipes in the prior art cooling plates ensures a more intensive solidification of cast iron used for cooling plates, thereby resulting in the decrease in carburization of the ducts for the cooling medium.

It is preferred to introduce the cooling pipe of the projection, forming an enclosed loop of circulation of the cooling medium, into the duct for the cooling medium. Such an arrangement makes it possible to eliminate labour-consuming operations of finding and disconnecting the burnt pipes of the bearing projection, since the above pipes are not directly connected with an external system for feeding the cooling medium, water in particular. In this case, uncontrolled entrance of water into the furnace is eliminated.

To increase the reliability of cooling it is expedient that the duct for the cooling medium be extending over the whole height of the plate.

BRIEF DESCRIPTION OF DRAWINGS

The invention is further described in terms of specific embodiment thereof with reference to the accompanying drawings, in which.

BEST MODE FOR CARRYING OUT THE INVENTION

Figure 2:
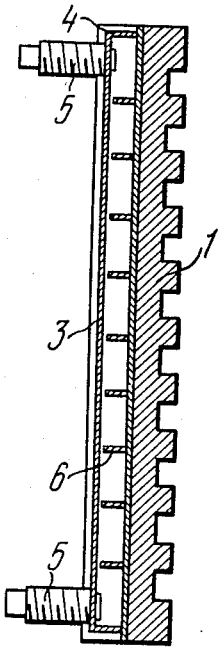
FIG. 2 is a view taken along the line 2—2 in FIG. 1.
Figure 1:
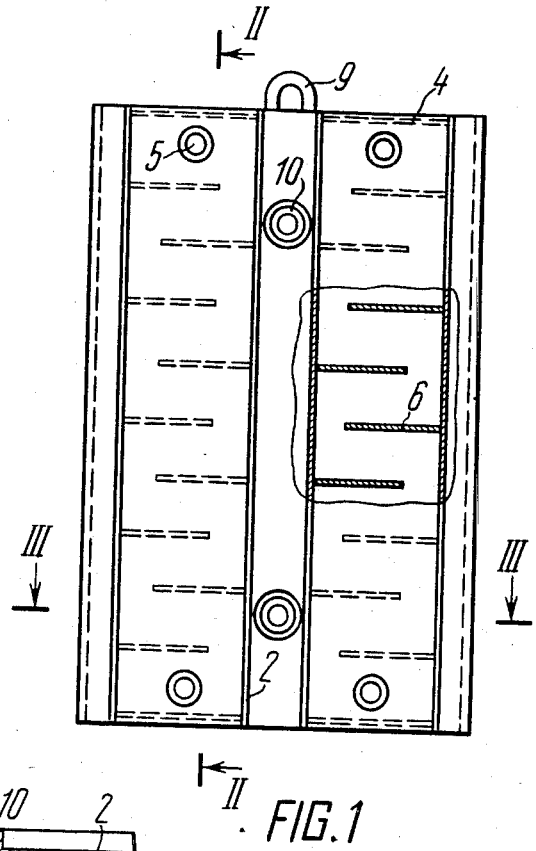
FIG. 1 is a rear view of the cooling plate of the invention, a portion of the duct for the cooling medium being cut away to illustrate inner structure thereof.
Figure 3:
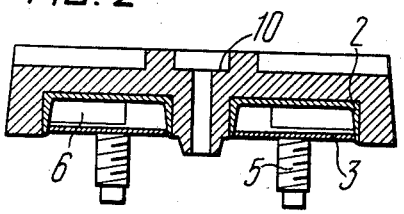
FIG. 3 is a view taken along the line 3—3 in FIG. 2.

As shown in FIG. 1, the cooling plate utilized to illustrate the present invention, is a cast iron plate 1, though other materials are possible, e.g. steel or copper alloys. Channels 2 (two channels in the given example) are embedded to their depth in space relationship in the plate 1 so that the channel wall is disposed substantially parallel to the temperature front, the channel legs are not extending beyond the rear surface of the plate, which is best seen in FIGS. 2 and 3. The channels 2 are closed with rear cover plates 3 forming together with corresponding channels ducts for cooling medium.

In the present embodiment of the invetion the cover plate 3 is a steel sheet welded to the channel legs. It is preferred to provide the cooling ducts extending over the whole height of the plate, i.e. to utilize the channesl 2 equal to the plate 1 in length (the vertical direction in FIGS. 1 and 2). In the upper and lower portions of the plate, or on the end faces of the channels 2 are mounted end cover plates 4 (these cover plates are mounted in the same manner as the cover plates 3) forming an enclosed of cooling cavity. On the end portions of the rear cover plates 3, or near the end cover plates 4 are provided branch pipes 5 for feeding the cooling medium, e.g. water into the cooling duct and for discharging the same from this duct.

To provide a desired velocity of the cooling medium, within the cooling cavities of the channels 2 there may be built in horizontal baffles 6 (FIGS. 1 through 3), successively extending from one of the channel legs and not reaching the opposite leg, thereby forming the movement of the cooling medium, being directed along a zigzag or serpentine path. To obtain a guaranteed serpentine duct for the cooling medium and to facilitate assemblying of such a duct, grooves or slots (not shown) may be made in a sheet forming the rear cover plate 3 in the locations of the baffles 6. In the case of the provision of the slots, the baffles 6 may extend beyond the external surface of the rear cover plate 3 to weld said baffles to this cover plate from outside.

Figure 5:
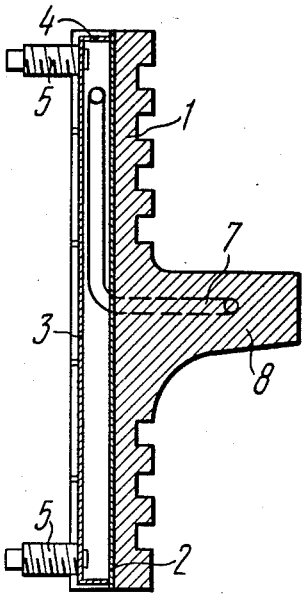
FIG. 5 is a view taken along the line 5—5 in FIG. 4.
Figure 4:
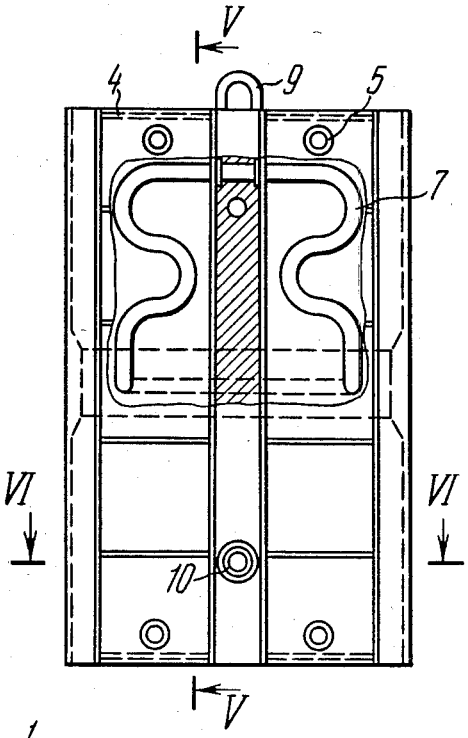
FIG. 4 is a view of the cooling plate of the invention, having a supporting projection shown from the rear side, a portion of the duct for the cooling medium being cut away to illustrate the inner portion thereof.
Figure 6:
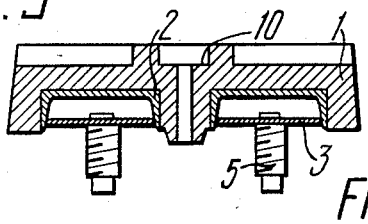
FIG. 6 is a view taken along the line 6—6 in FIG. 4.

According to another embodiment of the invention, a cooling pipe 7 of a projection 8 is introduced into the cooling duct, said duct being formed by the channels 2. The pipe 7 is closed and partially filled with the cooling medium. The quantity of the cooling medium in the pipe 7 depends on thermal characteristics of the cooling medium proper and on the operating conditions, and for this reason is not defined precisely in this specification. As seen in FIG. 5, a portion of the pipe 7 is disposed within the body of the supporting projection 8, while another portion thereof (namely a condensation portion) is disposed within the cavity of the channels 2, thereby forming a closed loop of circulation of the cooling medium. The condensation portion of the pipe 7 may be introduced only into the cavity of one of the channels 2, though the embodiment illustrated in FIGS. 4 and 5 ensures cooling of the projection 8 even when supply into one of the cavities is discontinued. Moreover, the supporting projection may be provided with two pipes 7 whose cooled or condensation portions can be located separately within different cooling cavities.

According to the invention, the cooling plate is provided with a mounting clamp 9 and openings 10 to receive mounting bolts.

The cooling plate described and illustrated in the accompanying drawings has the following advantages as compared with the prior art devices:

- uniformity and high reliability of cooling the heat-plate, which are ensured due to the fact that the duct for the cooling medium has a developed heat-receiving surface area;
- stresses existing within the plate and the ducts for the cooling medium are reduced since the branch pipes and the rear cover plates are not embedded in the plate body;
- carburization of the walls of the cooling ducts is reduced due to a more intensive solidification of the plate metal and to the massive nature of the channel during the manufacture of the cooling plate;
- labour-consuming operations in finding and disconnecting the burnt-through pipes of the bearing projection are eliminated since said pipes are not connected with the external system of water supply;
- uncontrolled entrance of water into the furnace due to burning-through of the pipes of the supporting projection is eliminated.

INDUSTRIAL APPLICABILITY

The cooling plate of the invention is widely used in metallurgical furnaces, and mainly in blast furnaces.

We claim:

1. A cooling plate for metallurgical furnaces, comprising a duct for a cooling medium and being in the form of a channel formed in a metal plate and oriented in the direction of the height of the plate, said channel having its rear and end sides, respectively, closed with rear and end cover plates, said channel being defined at one side by the plate and its opposite side by the rear cover plate spaced from said metal plate, and branch pipes provided on the rear cover plate adapted to feed a cooling medium into the duct and discharge the same therefrom, said duct having introduced thereinto a cooling pipe of a supporting projection so as to form a closed loop for circulation of the cooling medium.

2. A cooling plate according to claim 1, wherein the duct for the cooling medium extends along the full height of the plate.

* * * * *